US010968007B2

(12) United States Patent
Saito et al.

(10) Patent No.: US 10,968,007 B2
(45) Date of Patent: Apr. 6, 2021

(54) BAG IN BOX CONTAINER AND BOX THEREFOR

(71) Applicant: Scholle IPN Corporation, Northlake, IL (US)

(72) Inventors: Alessandra Saito, Sao Paulo (BR); Fabio Wu, Sao Paulo (BR)

(73) Assignee: Scholle IPN Corporation, Northlake, IL (US)

( * ) Notice: Subject to any disclaimer, the term of this patent is extended or adjusted under 35 U.S.C. 154(b) by 104 days.

(21) Appl. No.: 15/864,512

(22) Filed: Jan. 8, 2018

(65) Prior Publication Data

US 2018/0201405 A1 Jul. 19, 2018

Related U.S. Application Data

(60) Provisional application No. 62/445,904, filed on Jan. 13, 2017.

(51) Int. Cl.

| | |
|---|---|
| ***B65D 5/74*** | (2006.01) |
| ***B65D 5/60*** | (2006.01) |
| ***B65D 5/46*** | (2006.01) |
| ***B31B 50/74*** | (2017.01) |
| ***B65D 77/06*** | (2006.01) |
| ***B65D 77/22*** | (2006.01) |

(Continued)

(52) U.S. Cl.

CPC ..... *B65D 5/606* (2013.01); *B31B 50/74* (2017.08); *B65D 5/327* (2013.01); *B65D 5/46072* (2013.01); *B65D 5/727* (2013.01); *B65D 5/746* (2013.01); *B65D 77/065* (2013.01); *B65D 77/22* (2013.01)

(58) Field of Classification Search

CPC .. B65D 77/062; B65D 77/065; B65D 77/068; B65D 77/067; B65D 5/32; B65D 5/322; B65D 5/324; B65D 5/325; B65D 5/443; B65D 5/6626; B65D 5/6602; B65D 5/606; B65D 5/327; B65D 5/46072; B65D 5/727; B65D 5/746; B65D 5/321; B65D 77/22; B65D 5/60; B65D 5/603; B31B 50/74

USPC ..... 229/117.3, 117.27, 117.31, 117.32, 229/117.28, 117.29, 117.33–117.35, 229/122.23, 122.32, 122.34, 127

See application file for complete search history.

(56) References Cited

U.S. PATENT DOCUMENTS 2,175,476 A * 10/1939 Martin, Jr. ..... B65D 5/324 229/117.17
6,168,074 B1 * 1/2001 Petriekis ..... B65D 5/323 229/122.24

(Continued)

FOREIGN PATENT DOCUMENTS

| | | |
|---|---|---|
| WO | 2005000705 A1 | 1/2005 |
| WO | 2006051284 A2 | 5/2006 |
| WO | 2007057677 A1 | 5/2007 |

*Primary Examiner* — Christopher R Demeree
*Assistant Examiner* — Nina K Attel
(74) *Attorney, Agent, or Firm* — The Watson IP Group, PLC; Jovan N. Jovanovic

(57) ABSTRACT

A container having an outer carton and a collar. The outer carton has an outer wrap portion and an inner wrap portion each defined by a plurality of panels that cooperatively define a rectangular cubic configuration. An opening for a collar defined in at least one panel of each of the outer and inner wrap portions. The collar is attachable to the inner wrap portion and the outer wrap portion, with a portion thereof positioned between panels thereof.

15 Claims, 8 Drawing Sheets

(51) Int. Cl.
*B65D 5/72* (2006.01)
*B65D 5/32* (2006.01)

(56) References Cited

U.S. PATENT DOCUMENTS

| | | | | |
|---|---|---|---|---|
| 6,637,623 | B2 * | 10/2003 | Muise | B65D 5/5045 222/105 |
| 8,261,964 | B2 * | 9/2012 | Raupach | B65D 77/065 229/117.3 |
| 2008/0267538 | A1 * | 10/2008 | Stephenson | B65D 25/16 383/33 |

* cited by examiner

BAG IN BOX CONTAINER AND BOX THEREFOR

CROSS-REFERENCE TO RELATED APPLICATION

The present application claims priority from U.S. Pat. App. Ser. No. 62/445,904 filed Jan. 13, 2017, entitled "Bag in Box Container and Box Therefor", the entire specification of which is hereby incorporated by reference in its entirety.

BACKGROUND OF THE DISCLOSURE

1. Field of the Disclosure

The disclosure relates in general to bag in box configurations, and more particularly, to a bag in box container which is configured for use in association with a collar. Additionally, the container with the collar is likewise disclosed, are methods of manufacture.

2. Background Art

The use of bag in box configurations is known. The use of containers which are generally intended for dispensing of fluids (as, for example, replacements for jerrycans or other similarly shaped rigid containers) is known in the art. Some of the prior art of such bag in box configurations is disclosed in PCT Pub. No. WO 2005/000705 (PCT App. No. PCT/GB2004/002609) published to Stephenson, PCT Pub. No. WO 2006/051284 (PCT App. No. PCT/GB2005/004313) published to Stephenson, and PCT Pub. NO. WO2007/057677 (PCT App. No. PCT/GB2006/004284) published to Stephenson.

Despite the advancements shown in these references, there remain problems associated with such containers. For example, such containers generally lack the robustness to handle hazardous materials, as the collar to box configurations lack adequate strength. Moreover, in addition to the box strength, the interface and retention of the components is often lacking in the prior art.

SUMMARY OF THE DISCLOSURE

The disclosure is directed to a container having an outer carton and a collar. It is the collar to carton relationship, as well as the carton configuration which allow the use of the container in applications where such use has heretofore been difficult.

The outer carton includes an outer wrap portion and an inner wrap portion each defined by a plurality of panels that cooperatively define a rectangular cubic configuration. An opening for a collar defined in at least one panel of each of the outer and inner wrap portions.

The collar is attachable to the inner wrap portion and the outer wrap portion, with a portion thereof positioned between panels thereof.

Such a configuration is capable of use and can pass the requirements of ANTT 420 legislation.

As explained, the configuration shown includes double and triple wall construction to achieve the requisite configuration.

In greater detail, in an aspect of the disclosure, the disclosure is directed to a container comprising an outer carton and a collar. The outer carton has an outer wrap portion and an inner wrap portion each defined by a plurality of panels that cooperatively define a rectangular cubic configuration. An opening for a collar is defined in at least one panel of each of the outer and inner wrap portions. The collar is attachable to the inner wrap portion and the outer wrap portion, with a portion thereof positioned between panels thereof.

In some configurations, the inner carton wrap portion includes a frontal top panel, a front panel extending from the top front panel, a base panel extending from the top front panel opposite the frontal top panel, and a back panel extending from the base panel opposite the front panel, with the opening defined in the front panel and the frontal top panel and extending about an edge therebetween.

In some configurations, the outer carton wrap portion includes an outer top panel, a first side panel extending from the outer top panel, a bottom panel extending from the first side panel opposite the outer top panel, a second side panel extending from the bottom panel opposite the first side panel, and an inner top panel extending from the second side panel opposite the bottom panel. In such a configuration, the inner upper panel and the outer upper panel each include a slot corresponding to the opening defined in the inner carton wrap portion.

In some configurations, in the assembled container the inner upper panel overlying the frontal top panel, and the outer upper panel overlying the inner upper panel.

In some configurations, the outer upper panel includes a pair of front wings extending on either side of the slot defined therein. The front wings are foldable over a portion of the front panel of the inner carton wrap portion so as to overlie the same.

In some configurations, the inner carton wrap portion further includes a rear top panel extending from the back panel opposite the base panel. In the assembled container, the frontal top panel overlies the rear top panel.

In some configurations, the rear top panel is smaller than the frontal top panel.

In some configurations, the inner carton wrap further includes front panel wings extending outwardly from the front panel, and back panel wings extending outwardly from the back panel. The front panel wings and the back panel wings are attachable to an inner side of the first and second side panels of the outer carton wrap portion.

In some configurations, the inner carton wrap further includes base wings extending from the base panel. The base wings are attachable to the inner side of the first and second side panels.

In some configurations, the base wing, the front panel wing and the back panel wing extending to one side of the base panel, the front panel and the back panel in the assembled container are substantially coplanar.

In some configurations, the first side panel further includes first side wings extending outwardly therefrom. The second side panel further includes second side wings extending outwardly therefrom. The first side wings and the second side wings being positionable and attachable to an outer surface of the front panel and the back panel, respectively.

In some configurations, the bottom panel further includes bottom wings extending outwardly therefrom. The bottom wings are positionable and attachable to an outer surface of the front panel and back panel, respectively.

In some configurations, in the assembled container, the base panel is positioned over an inner surface of the bottom panel.

In some configurations, the collar further includes a base, an upstand and a carton engaging flange. The carton engaging flange engages the opening of the outer carton.

In some configurations, the upstand extends from the perimeter of the base and terminates at the carton engaging flange.

In some configurations, the base substantially corresponds to the shape of the opening on the top panel.

In another aspect of the disclosure, the disclosure is directed to an outer carton for a container. The outer carton includes an outer wrap portion and an inner wrap portion each defined by a plurality of panels that cooperatively define a rectangular cubic configuration, with an opening for a collar defined in at least one panel of each of the outer and inner wrap portions. The inner carton wrap portion includes a frontal top panel, a front panel extending from the top front panel, a base panel extending from the top front panel opposite the frontal top panel, and a back panel extending from the base panel opposite the front panel, with the opening defined in the front panel and the frontal top panel and extending about an edge therebetween. The outer carton wrap portion includes an outer top panel, a first side panel extending from the outer top panel, a bottom panel extending from the first side panel opposite the outer top panel, a second side panel extending from the bottom panel opposite the first side panel, and an inner top panel extending from the second side panel opposite the bottom panel. The inner upper panel and the outer upper panel each include a slot corresponding to the opening defined in the inner carton wrap portion.

In some configurations, in the assembled container the inner upper panel overlying the frontal top panel, and the outer upper panel overlying the inner upper panel.

In some configurations, the outer upper panel includes a pair of front wings extending on either side of the slot defined therein, the front wings foldable over a portion of the front panel of the inner carton wrap portion so as to overlie the same.

In some configurations, the inner carton wrap portion further includes a rear top panel extending from the back panel opposite the base panel. In the assembled container, the frontal top panel overlies the rear top panel.

In some configurations, the rear top panel is smaller than the frontal top panel.

In some configurations, the inner carton wrap further includes front panel wings extending outwardly from the front panel, and back panel wings extending outwardly from the back panel. The front panel wings and the back panel wings are attachable to an inner side of the first and second side panels of the outer carton wrap portion.

In some configurations, the inner carton wrap further includes base wings extending from the base panel. The base wings are attachable to the inner side of the first and second side panels.

In some configurations, the base wing, the front panel wing and the back panel wing extending to one side of the base panel, the front panel and the back panel in the assembled container are substantially coplanar.

In some configurations, the first side panel further includes first side wings extending outwardly therefrom. The second side panel further includes second side wings extending outwardly therefrom. The first side wings and the second side wings being positionable and attachable to an outer surface of the front panel and the back panel, respectively.

In some configurations, the bottom panel further includes bottom wings extending outwardly therefrom. The bottom wings are positionable and attachable to an outer surface of the front panel and back panel, respectively.

In some configurations, in the assembled container, the base panel is positioned over an inner surface of the bottom panel.

In some configurations, each of the outer carton wrap portion and the inner carton wrap portion comprise a corrugated paperboard.

In some configurations, the inner cartridge assembly is maintained within the volume defined by the outer carton.

In some configurations, the inner carton wrap portion and the outer carton wrap portion include a handle opening, in the assembled outer carton, the handle openings align to form a single opening.

In some configurations, the side edges defined by the intersection of a side panel with a font or back panel comprise multiple plies.

In some configurations, the base panel and the bottom panel define four edges, with each of the edges having multiple plies.

In some configurations, the container can pass the requirements of ANTT 420 legislation.

BRIEF DESCRIPTION OF THE DRAWINGS

The disclosure will now be described with reference to the drawings wherein.

DETAILED DESCRIPTION OF THE DISCLOSURE

Figure 1:
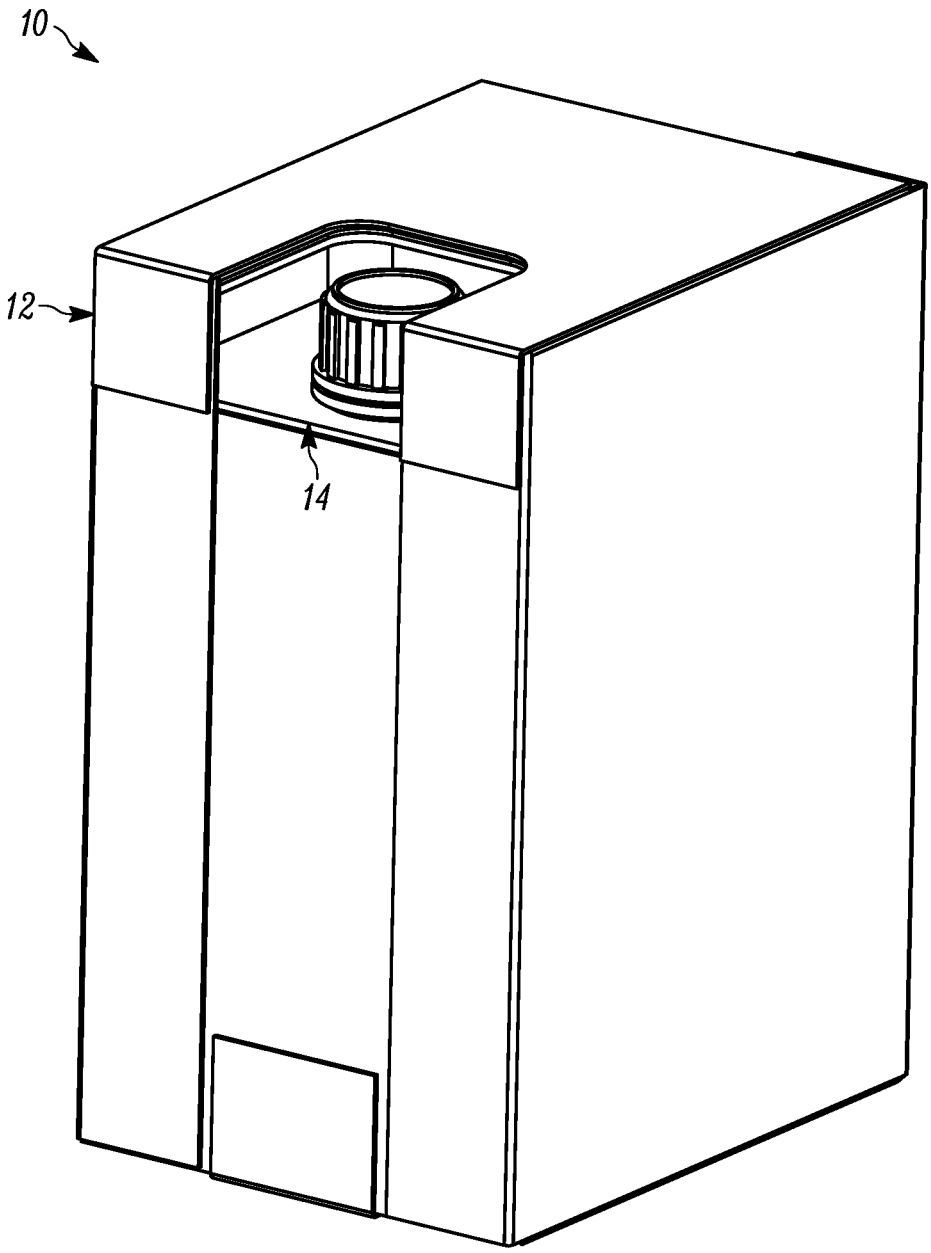
FIG. 1 of the drawings is a top, front, side perspective view of the container of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and the additional disclosure the container is generally referred to as 10 and most appropriately seen in the additional disclosure and in FIG. 1. The container can be formed from the inner carton wrap portion and the outer carton wrap portions which is shown in FIGS. 2A and 2B, and, is configured to accept a cartridge (or collar member, along with a bag and having a spout attached thereto) which is shown in FIGS. 3A and 3B.

It will be understood that the container can be filled with a flowable material, and the flowable material may be dispensed therefrom. It will be understood that in such a construction, as shown, the container can comply with ANTT 420 as well as pass drop tests at low temperature and the like.

The container, with further reference to 2, includes outer carton 12 and inner cartridge assembly 14. The outer carton surrounds, supports and retains the cartridge assembly 14. It will be understood that the cartridge assembly 14 may include a collar with a spout coupled to the collar and a bag coupled to the spout. It will be understood that the particular combination and configuration of these components (i.e., whether provided as a cartridge, or separately assembled from multiple components prior to or after assembly of the box) is not to be limited by the term cartridge; rather, the term is meant to encompass these components regardless of the configuration and manner of coupling.

Figure 2A:
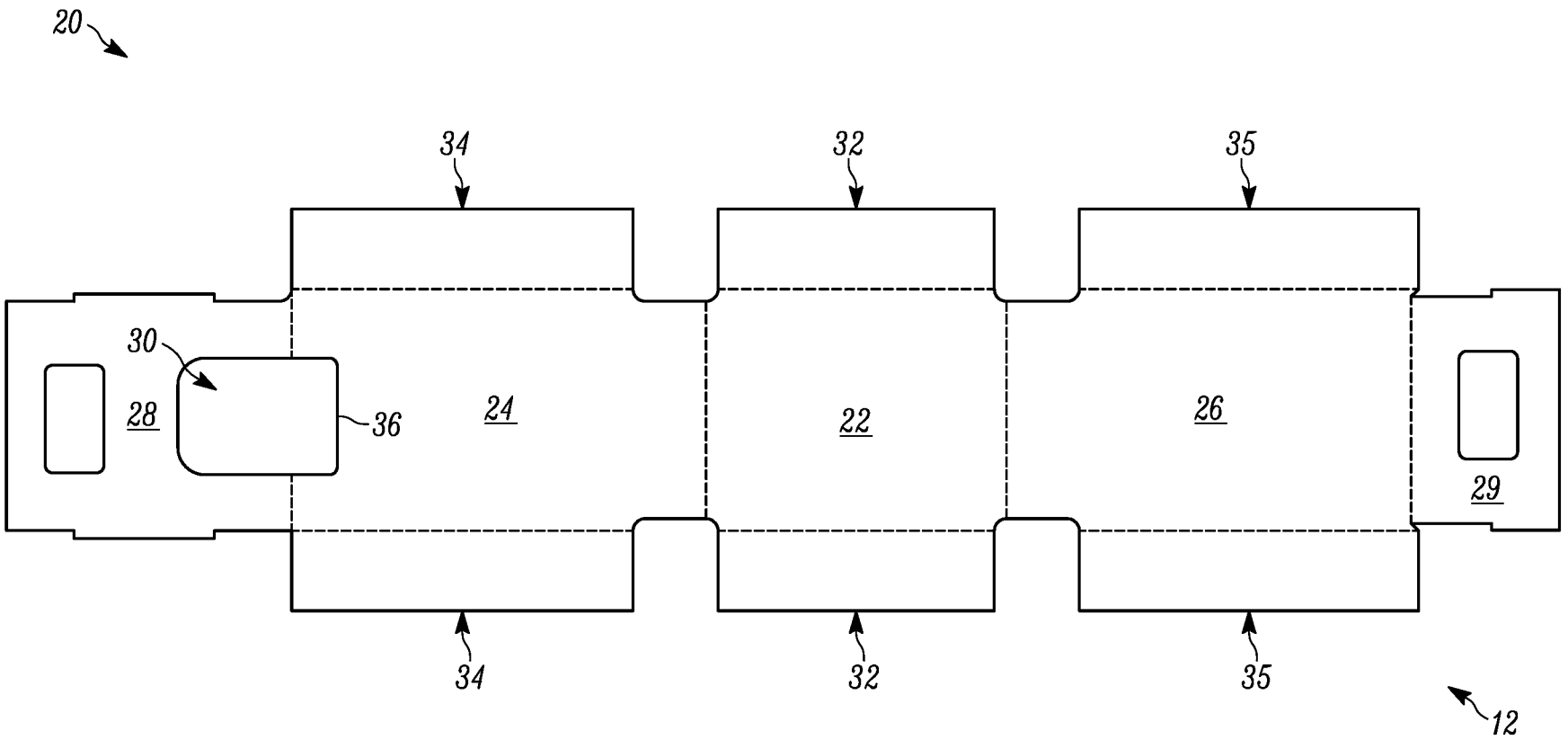
FIG. 2A of the drawings is a top plan view of the blank for the outer carton wrap portion of the outer carton.
Figure 2B:
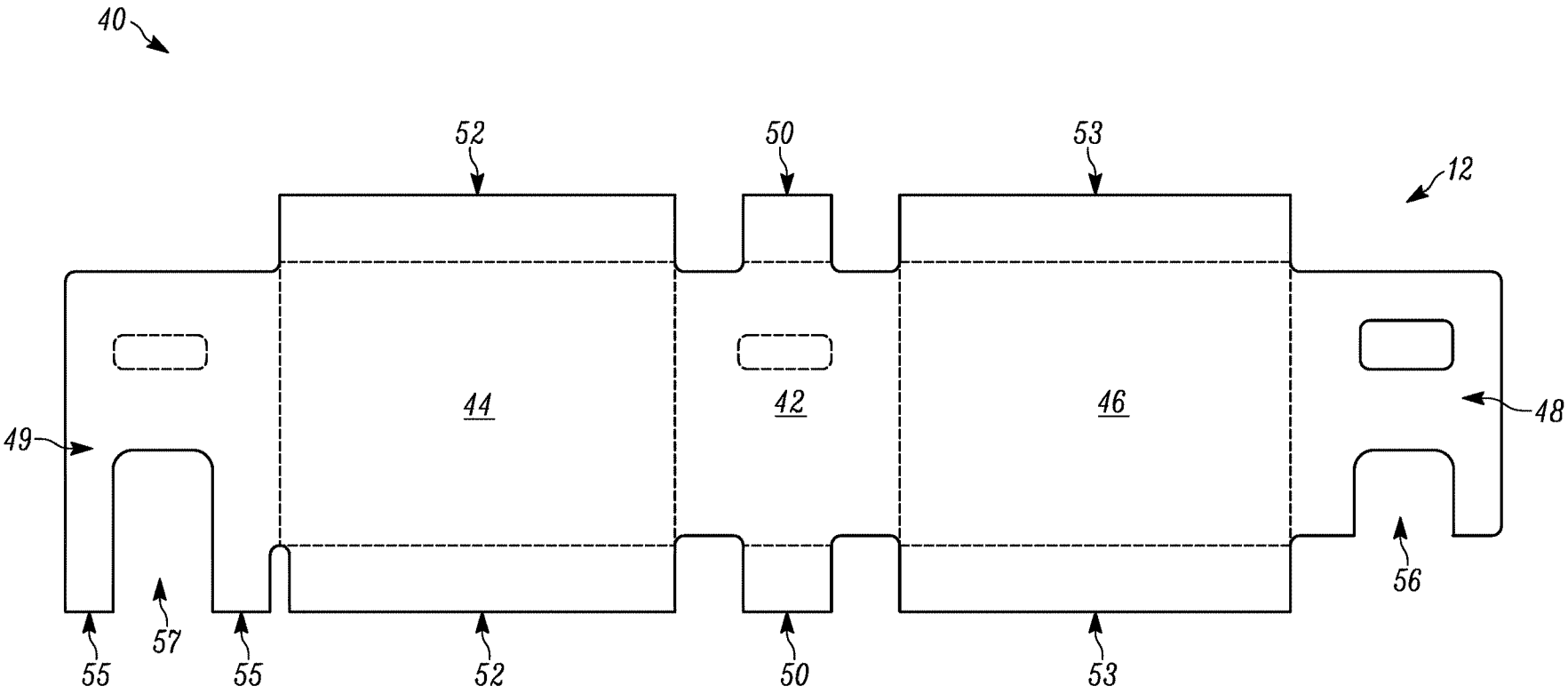
FIG. 2B of the drawings is a top plan view of the blank for the inner carton wrap portion of the outer carton.
Figure 3A:
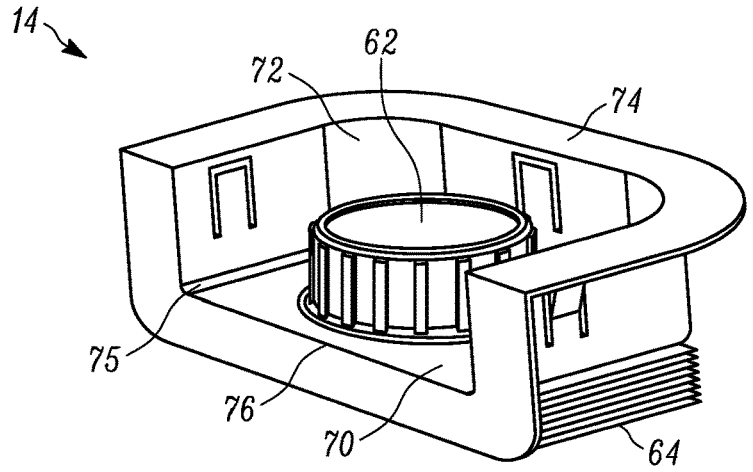
FIG. 3A of the drawings is a perspective view of an exemplary inner cartridge assembly.
Figure 3B:
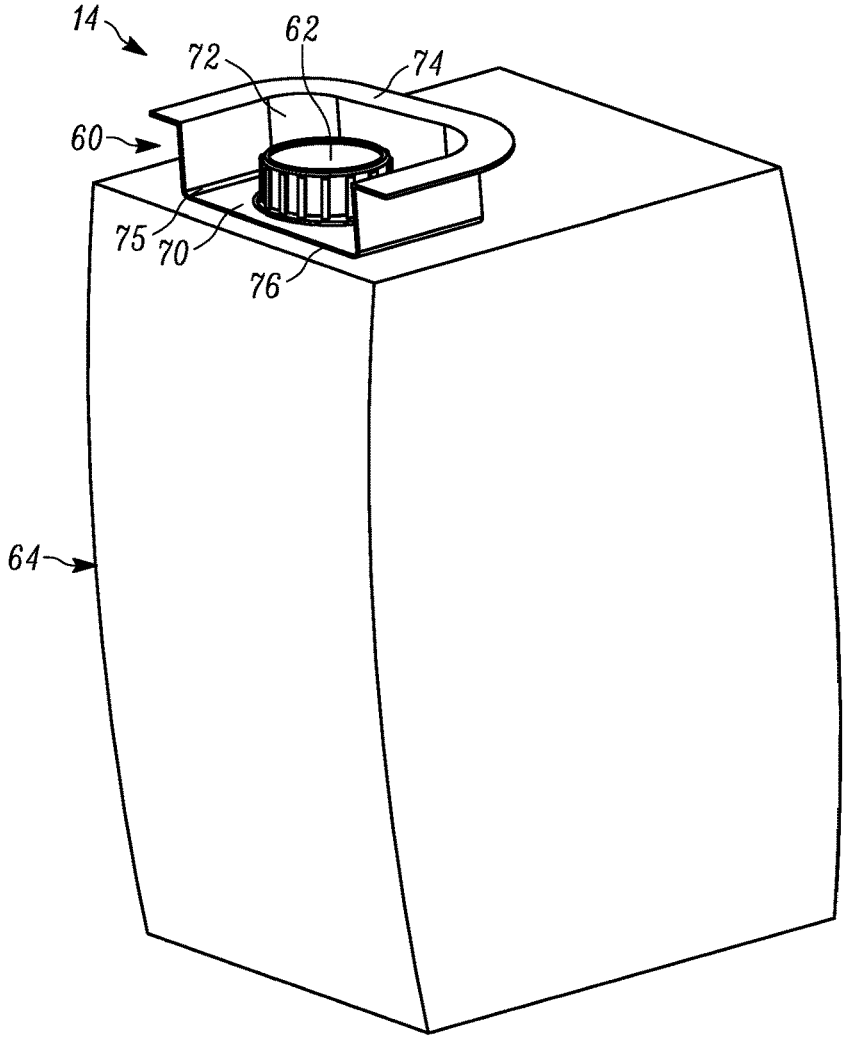
FIG. 3B of the drawings is a perspective view of another exemplary inner cartridge assembly, showing, in particular, a configuration that has a straight front edge and with the bag in the deployed configuration.
Figure 4:
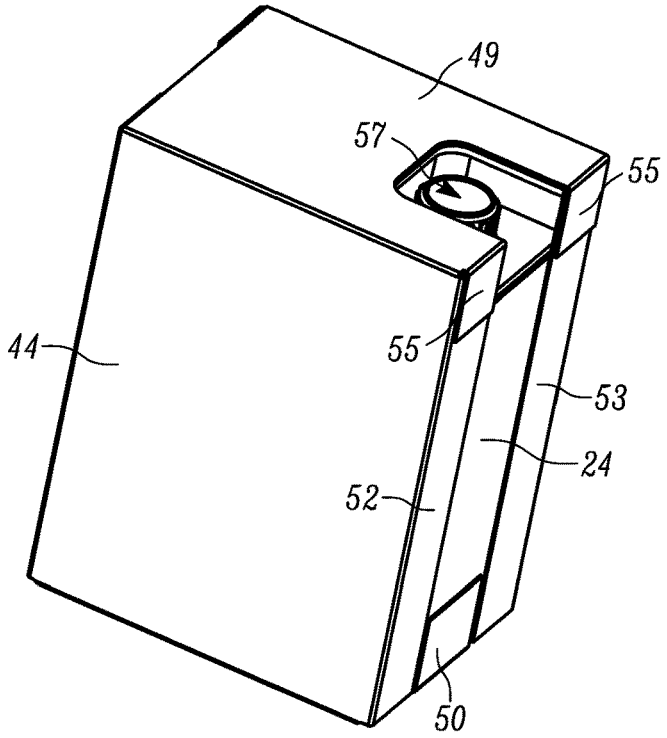
FIG. 4 of the drawings is a top, front, side perspective view of the container of the present disclosure.
Figure 5:
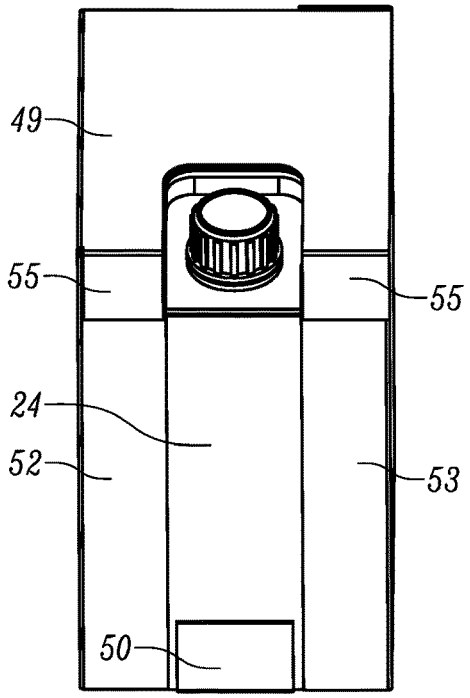
FIG. 5 of the drawings is a top, front perspective view of the container of the present disclosure.
Figure 6:
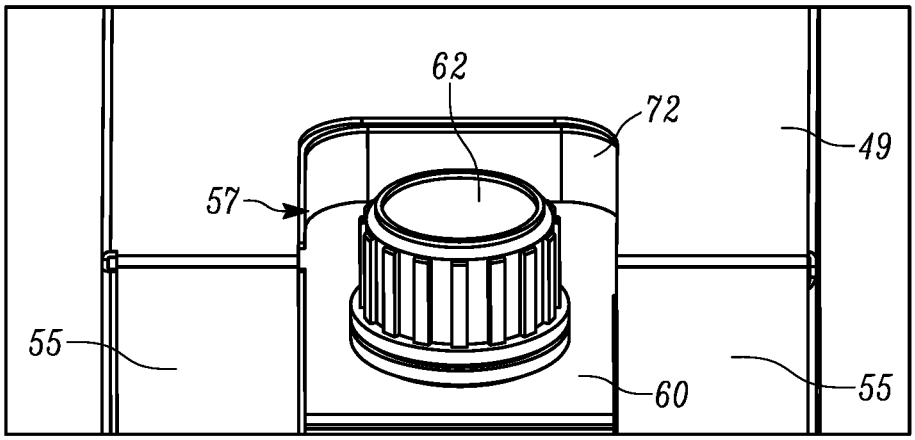
FIG. 6 of the drawing is a partial top, front perspective view of the container of the present disclosure, showing, in particular, the opening and the inner cartridge assembly.
Figure 7:
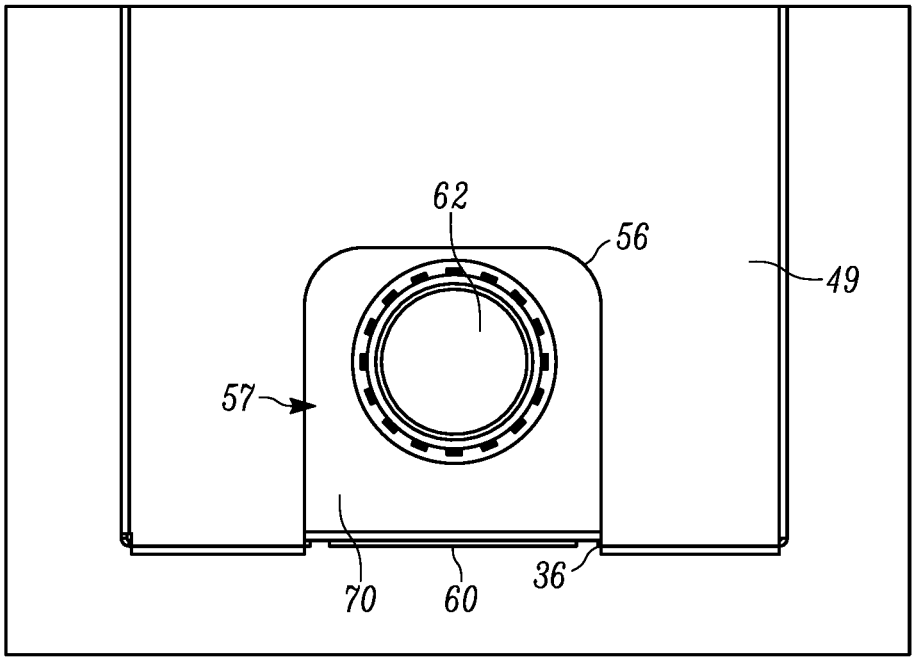
FIG. 7 of the drawings is a partial top plan view of the container of the present disclosure, showing, in particular, the opening and the inner cartridge assembly.
Figure 8:
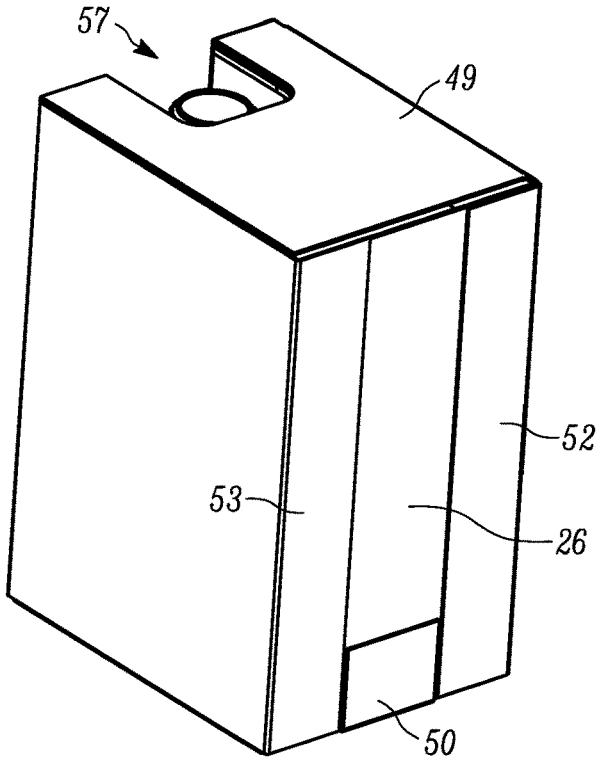
FIG. 8 of the drawings is a top, back, side perspective view of the container of the present disclosure.
Figure 9:
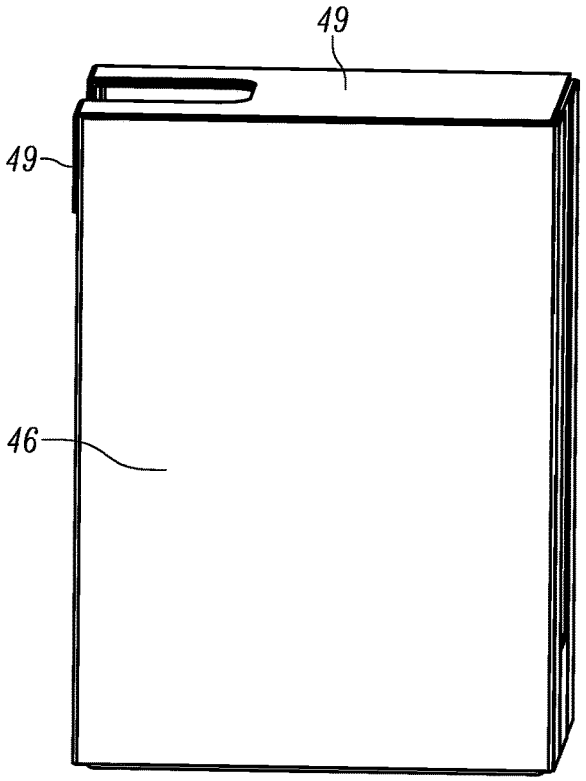
FIG. 9 of the drawings is a side elevational view of the container of the present disclosure.
Figure 10:
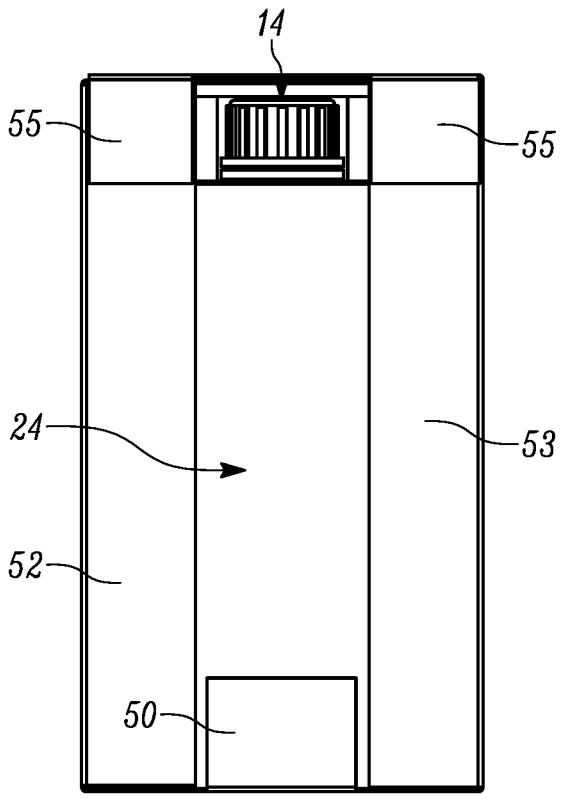
FIG. 10 of the drawings is a front elevational view of the container of the present disclosure.
Figure 11:
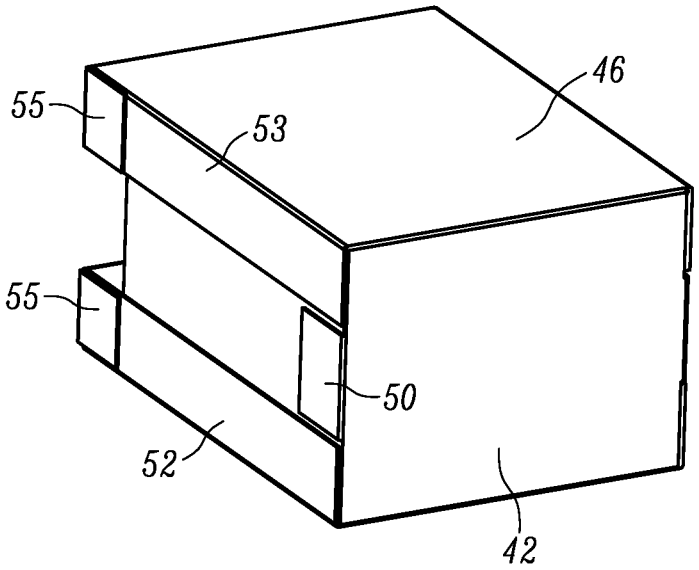
FIG. 11 of the drawings is a bottom, front, side perspective view of the container of the present disclosure.

With reference to FIGS. 2A and 2B, the outer carton 12 includes inner carton wrap portion 20 and outer carton wrap portion 22, both of which cooperate to form the outer carton 12. In the configuration shown, each is formed of a corrugated paperboard material, although other materials, such as polymer based corrugated materials, along with sheet materials of various types is likewise contemplated. With reference to FIG. 2A, the inner carton wrap portion 20 includes base panel 22, front panel 24, back panel 26, frontal top panel 28, and rear top panel 29. In the configuration shown, starting with the base panel, the front panel shares a fold with the base panel at one end and the frontal top panel at the other end. The base panel, opposite the front panel, shares a fold with the back panel at one end and with the rear top panel at the other end. The front and rear panels have substantially the same dimensional configuration (with variance for proper overlapping of components). The top panels overlie each other so as to have surfaces which can be adhered to each other.

Each of the base panel 22 and the front and back panels 24, 26 include opposing wings. For example, the base panel 22 includes base wings 32. The front panel 24 includes front panel wings 34 and the back panel 26 includes back panel wings 35. The wings can be bent so as to overlie a portion of the outer carton wrap portion, and to be adhered thereto. Corresponding openings that overlap can be present in the rear top panel 29 and the frontal top panel 28 to provide for insertion of a user's hand, and to form a handle structure.

Opening 30 is presented for a collar. The opening spans a portion of an upper end of the front panel 24 and a portion of a front region of the frontal top panel 28 so as to straddle what would have otherwise been the fold between the panels. The opening 30 defines an outer perimeter 36 which generally, when the blank is folded, corresponds to the configuration of the collar of the inner cartridge assembly, and spans the front panel 24 and the frontal top panel 28.

With reference to FIG. 2B, the outer container wrap portion 40 includes bottom panel 42, first side panel 44, second side panel 46, inner upper panel 48 and outer upper panel 49. It will be understood that the two blanks, when coupled are offset by 90° so that the side panels and the front/back panels are perpendicular to each other, and so that the combination forms a rectangular cubic configuration having multiple plies for the top/upper panels and the bottom/base panels. The bottom and side panels include opposing wings. For example, the bottom panel 42 includes opposing bottom wings 50. The first side panel includes first side wings 52. The second side panel includes second side wings 53.

The inner upper panel includes an opening which matches the handle openings formed on the top panels 28, 29. The inner upper panel further includes a slot 56 that generally matches the portion of the perimeter 36 that is on the frontal top panel 29. Similarly, the outer upper panel 49 includes an opening that matches the handle openings. Further the outer upper panel 49 includes a slot 57 that generally matches the slot 56 formed in the inner top panel. The outer upper panel 49 includes a pair of front wings 55 that are on either side of the slot 57.

In the assembly, and with further reference to FIGS. 4 through 11, the inner structure is first assembled into a generally rectangular hoop. The adjacent panels are positioned and bent along fold lines so as to be substantially perpendicular to each other. The frontal top panel 28 is positioned to overlie at least a portion of the rear top panel 29 in abutment. The upper surface of the rear top panel 29 is then attached (generally through a glue or adhesive) to the frontal top panel 28.

Separately, the outer carton wrap portion 40 is provided and the folds are generally bend to form the separate panels. The base panel 22 of the inner carton wrap portion is positioned to overlie the bottom panel 42 of the outer carton wrap and the two are attached together. The first and second side panels are extended to fill the space between the front and back panel. The front and back wings 34, 35 are then adhered to the inner surface of the first and second side panels, respectively. With the rectangular cubic configuration taking shape, the first and second side wings are attached to the outside of the front and back panels 24, 26, respectively. In such a configuration the wings of the front and back panels are coupled to the first and second side panels, and the wings of the first and second side panels are coupled to the front and back panels.

At the same time, the base wings 32 of the base panel of the inner carton wrap portion are attached to the inner surfaces of the first and second side panels 44, 46 of the outer carton wrap portion. And, the bottom wings 50 of the outer carton wrap portion 40 are attached to the outer surfaces of the front and back panels, resulting in two ply configurations at each of the edges where the structures meet, and a two ply configuration at the base. It will be understood that the wings on one side of the base panel and the front panels (i.e., the base wing, the front panel wing and the back panel wing to one side) are coplanar, as are the others on the opposite side of the base panel, the front panel and the back panel.

The upper portion of the assembly is not completed until the collar is inserted into the configuration. As such, we will briefly describe the cartridge and cartridge components so as to provide description as to the component, prior to final assembly.

The inner cartridge assembly 14 is shown in FIGS. 3A and 3B as comprising collar 60, spout 62 and bag 64. The particular configuration of such a member may be of the type shown in, for example, PCT Pub. No. WO 2005/000705 (PCT App. No. PCT/GB2004/002609) published to Stephenson, PCT Pub. No. WO 2006/051284 (PCT App. No. PCT/GB2005/004313) published to Stephenson, and PCT Pub. NO. WO2007/057677 (PCT App. No. PCT/GB2006/004284) published to Stephenson, the entire specification of each of the foregoing patent applications is hereby incorporated by reference in their entirety. Of course, the particular configuration is not limited thereto, and a number of different configurations of the inner cartridge assembly are contemplated. The member is referred to as an inner cartridge, with the understanding that it may comprise a cartridge as termed in the accompanying and incorporated applications to Stephenson, or, the components may be coupled together but maintained in a loose configuration. In either instance, the overall structure will be referred to as the inner cartridge.

It will be understood that the spout 62 and the bag 64 may be supplied to the collar after coupling with the container, or prior thereto. In addition, it will be understood that the spout and the bag may be provided in an extended configuration, or in a configuration that is folded and maintained within the footprint of the collar (and maintained in such a configuration by a frangible element).

The collar 60 includes base 70, upstand 72 and carton engaging flange 74. The collar 60 is generally integrally molded (and at times, may be integrally molded with the spout). Of course, it is not limited to such a configuration. The base 70 comprises a generally planar configuration of a uniform thickness. The base defines a perimeter 75 with a front portion or front edge 76 thereof. The base further includes an opening defined therein, which opening provides for receipt and coupling of the spout. It will be understood that the opening may include structures which retain and hold the spout and which preclude relative rotation of the spout and the collar.

The upstand 72 extends upwardly from an upper or outer surface of the base 70 and extends about the perimeter generally other than about the front portion 76. In the configuration shown, the upstand generally follows the majority of the outer perimeter outside of that portion and is generally perpendicular to the base 70. The carton engaging flange 74 may have multiple components. For example, a portion of the carton engaging flange may extend outwardly about a distal end of the upstand 72, generally on the opposite end from the base 70. Additionally, the front portion 76 of the base may include a carton engaging flange extending downwardly therefrom. The upstand portion edge that is defined by the upstand proximate the front portion of the base on either side, may include an outward engaging flange. Such a flange would be generally perpendicular to the portion of the carton engaging flange that extends outwardly from the upper end of the upstand. The carton engaging flange is configured to engage the surface of the carton and to be sandwiched between layers of the different panels so as to generally locate and fix the inner cartridge (collar) assembly relative to the outer carton.

With reference to FIGS. 1, and 4 through 11, the collar (with or without the bag and the spout) is positioned into the opening 30 of the inner wrap portion. The configuration of the opening is such that the base and upstand extend through the opening, but that the carton engaging flange 74 is too large to fit through the opening (and, indeed, the upstand generally follows the shape of the opening). As such, the carton engaging flange overlies a portion of the frontal top panel 28 about the perimeter 36 of the opening, and the carton engaging flange may, in some configurations, overlie a portion of the front panel 28 surrounding the portion of the perimeter 36 that is formed in the front panel. Depending on the configuration, the collar may have structures, such as tabs or fingers, which capture the portions of the panels between such structures and the carton engaging flange. In other configurations, collar may merely rely on its dimensional characteristics and shape relative to the opening to maintain the desired position. In still other configurations, the collar may be attached through a glue or an adhesive to the carton, to further limit relative movement.

Once positioned, the inner upper panel 48 is positioned to overlie the frontal top panel, and the rear top panel, such that the slot 56 corresponds to the opening 40 of the inner carton wrap portion. When positioned, the inner upper panel 48 overlies the carton engaging flange portions of the carton that are positioned over the frontal top panel 28 of the inner carton wrap portion 20. Effectively, the carton engaging flange of the collar is captured between, or sandwiched between, the frontal top panel 28 and the inner upper panel 48. It will be understood that the portion of the carton engaging flange that overlies the front panel may be positioned between the front panel and the first and second side wings 52, 53.

Once the inner upper panel is positioned, the outer upper panel 49 can be positioned to overlie the inner upper panel 48, with the slot 57 corresponding to the slot 56. In such a configuration, both plies of material (that is, both panels) extend over the carton engaging flange 74 of the collar. Lastly, the front wings 55 are directed over and attached to, in the configuration shown, the first and second side wings 52, 53 which overlie the front panel (or, in other configurations the outer surface of the front panel 24 of the inner carton wrap portion 20). In the configuration shown, each of the side edges (that is, the vertical edges between the side panels and the front and back panel comprise both the inner carton wrap portion and the outer carton wrap portion, as to each of the edges of the base panel and the bottom panel It will be understood that in configurations wherein the bag and the spout have not been coupled to the collar previously, the same may now be coupled to the collar. In some configurations, the method disclosed in U.S. Pat. No. 9,498,929 issued to Scholle IPN Corporation, with the entire specification thereof also incorporated by reference. Of course, other methods may be utilized for the coupling of the spout and bag. In other configurations, as identified above, the spout and bag may already be coupled to the collar prior to incorporation into the outer carton.

In use, the carton is configured to survive substantially more stringent drop tests and the like. For example, it is contemplated that the container can be utilized for hazardous products wherein ANTT 420 requirements must be met. It will be understood that for drop testing, even in low temperatures (−18° C.), no leakage, bag explosion, cartridge or collar removal or other damage that exposes the inner bag is sustained. Additionally, the cartridge is fully maintained within the volume of the outer carton.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A container comprising:

an outer carton comprising a first outer carton wrap portion and a second inner carton wrap portion each defining a rectangular cubic configuration defined by a plurality of panels, with an opening for a collar defined in at least one panel of each of the first outer and second inner carton wrap portions; and the collar attachable to the second inner carton wrap portion and the first outer carton wrap portion, with a portion thereof positioned between panels thereof;

wherein the first outer carton wrap portion includes an outer top panel, a first side panel extending from the outer top panel, a bottom panel extending from the first side panel opposite the outer top panel, a second side panel extending from the bottom panel opposite the first side panel, and an inner top panel extending from the second side panel opposite the bottom panel, wherein the inner top panel and the outer top panel each include a slot corresponding to the opening defined in the second inner carton wrap portion;

wherein in the assembled container the inner top panel overlying the frontal top panel, and the outer top panel overlying the inner top panel; and wherein the outer top panel includes a pair of front wings extending on either side of the slot defined therein, the front wings foldable over a portion of the front panel of the second inner carton wrap portion so as to overlie the same.

2. The container of claim 1 wherein the second inner carton wrap portion includes a frontal top panel, a front panel extending from the frontal top panel, a base panel extending from the front panel opposite the frontal top panel, and a back panel extending from the base panel opposite the front panel, with the opening defined in the front panel and the frontal top panel and extending about an edge therebetween.

3. The container of claim 1 wherein the second inner carton wrap portion further includes a rear top panel extending from the back panel opposite the base panel, wherein in the assembled container, the frontal top panel overlies the rear top panel.

4. The container of claim 3 wherein the rear top panel is smaller than the frontal top panel.

5. The container of claim 1 wherein the second inner carton wrap portion further includes front panel wings extending outwardly from the front panel, and back panel wings extending outwardly from the back panel, the front panel wings and the back panel wings attachable to an inner side of the first and second side panels of the first outer carton wrap portion.

6. The container of claim 5 wherein the second inner carton wrap portion further includes base wings extending from the base panel, the base wings attachable to the inner side of the first and second side panels.

7. The container of claim 6 wherein the base wing, the front panel wing and the back panel wing extending to one side of the base panel, the front panel and the back panel in the assembled container are substantially coplanar.

8. The container of claim 6 wherein the first side panel further includes first side wings extending outwardly therefrom, the second side panel further includes second side wings extending outwardly therefrom, the first side wings and the second side wings being positionable and attachable to an outer surface of the front panel and the back panel, respectively.

9. The container of claim 8 wherein the bottom panel further includes bottom wings extending outwardly therefrom, the bottom wings being positionable and attachable to the outer surface of the front panel and back panel, respectively.

10. The container of claim 1 wherein in the assembled container, the base panel is positioned over an inner surface of the bottom panel.

11. The container of claim 1 wherein the collar further includes a base, an upstand and a carton engaging flange, the carton engaging flange engaging the opening of the outer carton.

12. The container of claim 11 wherein the upstand extends from the perimeter of the base and terminates at the carton engaging flange.

13. The container of claim 12 wherein the base substantially corresponds to the shape of the opening on the top panel.

14. An outer carton for a container comprising:

a first outer carton wrap portion and a second inner carton wrap portion each defining a rectangular cubic configuration defined by a plurality of panels, with an opening for a collar defined in at least one panel of each of the first outer and second inner carton wrap portions, wherein, the second inner carton wrap portion includes a frontal top panel, a front panel extending from the frontal top panel, a base panel extending from the front panel opposite the frontal top panel, and a back panel extending from the base panel opposite the front panel, with the opening defined in the front panel and the frontal top panel and extending about an edge therebetween, and wherein, the first outer carton wrap portion includes an outer top panel, a first side panel extending from the outer top panel, a bottom panel extending from the first side panel opposite the outer top panel, a second side panel extending from the bottom panel opposite the first side panel, and an inner top panel extending from the second side panel opposite the bottom panel, wherein the inner top panel and the outer top panel each include a slot corresponding to the opening defined in the second inner carton wrap portion, wherein in the assembled outer carton the inner top panel overlying the frontal top panel, and the outer top panel overlying the inner top panel; and wherein the outer top panel includes a pair of front wings extending on either side of the slot defined therein, the front wings foldable over a portion of the front panel of the second inner carton wrap portion so as to overlie the same.

15. The outer carton of claim 14 wherein the second inner carton wrap portion further includes a rear top panel extending from the back panel opposite the base panel, wherein in the assembled outer carton, the frontal top panel overlies the rear top panel.

* * * * *